United States Patent [19]

Maake

[11] 4,151,398

[45] Apr. 24, 1979

[54] CLOTHES DRYER HEATING UNIT

[75] Inventor: Douglas H. Maake, Cookeville, Tenn.

[73] Assignee: Gould Inc., Cleveland, Ohio

[21] Appl. No.: 600,267

[22] Filed: Jul. 31, 1975

[51] Int. Cl.[2] ..... F24H 3/04; F26B 11/00; H05B 3/12

[52] U.S. Cl. ..... 219/374; 219/367; 219/368; 219/376; 219/382; 219/532; 338/58; 338/206; 338/280

[58] Field of Search ..... 219/374–376, 219/381, 382, 532, 366–368, 370; 338/206, 280–292, 208, 53–58

[56] References Cited

U.S. PATENT DOCUMENTS

| | | | |
|---|---|---|---|
| 992,728 | 5/1911 | McElroy | 219/368 |
| 1,632,034 | 6/1927 | Moffitt | 219/367 X |
| 1,688,270 | 10/1928 | Doherty | 219/374 |
| 1,995,673 | 3/1935 | Evans | 219/370 |
| 2,522,542 | 9/1950 | Schaefer | 338/58 |
| 3,651,304 | 3/1972 | Fedor | 219/552 X |

FOREIGN PATENT DOCUMENTS

| | | | |
|---|---|---|---|
| 569228 | 1/1924 | France | 219/376 |
| 931179 | 1/1947 | France | 338/206 |
| 489782 | 8/1938 | United Kingdom | 219/375 |

*Primary Examiner*—A. Bartis

*Attorney, Agent, or Firm*—Berman, Aisenberg & Platt

[57] ABSTRACT

A forced convection electrical heater assembly advantgeously utilizing expanded resistance alloy foil or grid in a pattern which produces a uniform temperature distribution in the existing airstream and which produces relatively little flow restriction on the airstream. The resistance grid in the form of at least one continuous strip is strung in a sinuous path to form a plurality of planar reaches spaced uniformly across the flow passage and extending longitudinally from inlet to outlet. Grid support elements at the inlet and outlet are arranged to force air to pass through the resistance grid only once to thereby achieve a minimum flow restriction. Alternation of the grain of the expanded foil in each plane and between planes and the provision of a flow deflector at the exit contribute to temperature uniformity.

13 Claims, 6 Drawing Figures

Fig. 4
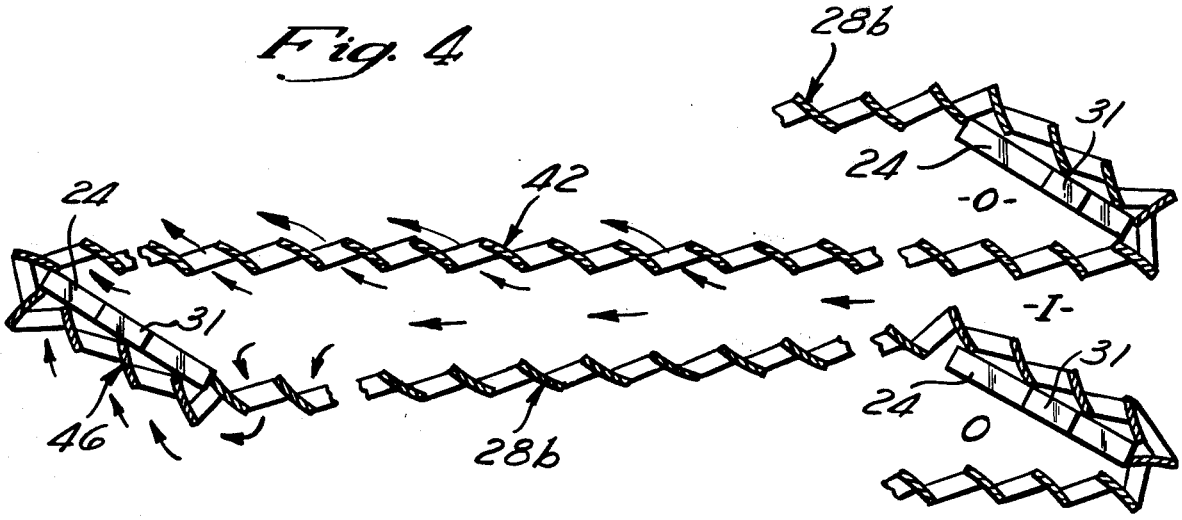
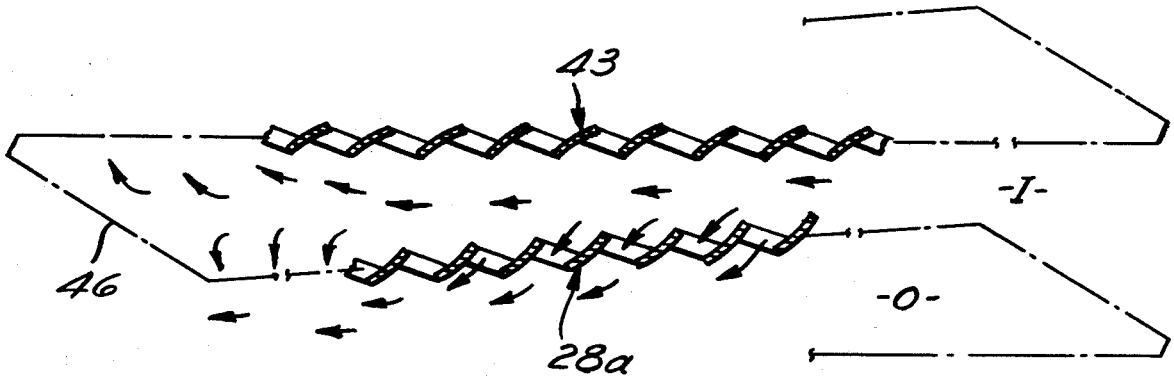
Fig. 5

CLOTHES DRYER HEATING UNIT

BACKGROUND OF THE INVENTION

The invention relates to electric resistance heaters and, more specifically, pertains to improvements in high convection rate heaters for forced air systems.

PRIOR ART

The invention represents improvements in the type of heater disclosed, for example, in U.S. Pat. Nos. 3,651,304 to Fedor and 3,860,789 to Maake. As disclosed in those patents, expanded foil or light gauge sheet of suitable resistance metal alloy characteristically provides a high surface area-to-mass ratio, and therefore an efficient convection heat transfer structure. As emphasized in these patents, a high rate of convection heat transfer and a correspondingly low rate of radiation heat transfer are desirable where it is intended to heat a mass of air. Radiant heat is ineffective to directly warm an air mass and generally is lost to surrounding surfaces from which it is carried off by conduction.

In the specific application of a domestic clothes dryer, articles in a closed compartment, usually a tumbling drum, are dried by circulating heated air therethrough to cause the moisture carried by clothing or other fabric articles to evaporate. Conventionally, air is heated in an area which is external of the clothes compartment; and is forcibly driven into the compartment by a suitable blower through interconnecting duct work. Radiant heat energy developed by the heater is not directly transmitted to the clothes, therefore, and is for the most part lost to the cabinet and surrounding environment, and obviously should be minimized.

Another significant consideration in clothes drying systems is the velocity of the air circulating about the clothes articles. A high velocity in the clothes chamber can be expected to yield a proportionately high drying rate as the natural result of greater heat convection activity at the surfaces of the clothes articles being dried. It is therefore important that air flow through a heater unit not be unnecessarily restricted by its elements or structural configuration.

A particularly important consideration in drying synthetic fabrics and so-called delicate fabrics is the temperature uniformity of the airstream leaving the heater unit. Excessive temperature variation across the airstream may result in difficulties for the user in selecting an appropriate nominal temperature range, and in extreme cases may result in harm to the fabrics being dried.

SUMMARY OF THE INVENTION

In accordance with the invention, improved air discharge temperature uniformity and reduced air flow restriction in a convection heater device are achieved by arranging lengths of resistance alloy grid planes parallel to a net air flow direction through the device, with the planes spaced evenly throughout the cross section of the flow passage. In addition to the advantages of temperature uniformity and low flow restriction, the invention also provides an electrical heating device which is adapted to take full advantage of the convection heat transfer efficiency of expanded metal foil. With the disclosed structure, air is required to pass only once through expanded metal grid lengths, so that an excessive pressure drop is not produced in the airstream passing through the device and a high downstream air velocity is available for full drying capacity.

A plurality of expanded metal grid lengths are advantageously serially interconnected for purposes of economic manufacture and suitable electrical properties. The resistance grid is strung in a sinuous path with the points of path reversal being arranged in a uniformly spaced array at the entrance and exit ends of the flow passage. The resistance grid is supported at each path reversal point by an insulator body which effectively blocks the flow passage area between the associated pair of supported grid lengths. By this manner of support and flow blockage, the overall flow passage is sectioned by the grid lengths into longitudinal zones, with alternate zones admitting air at the entrance end of the heater device and intervening zones exhausting air at the exit end. Passage of air from the inlet zones to the outlet zones thereby requires only one pass through the grid lengths. Efficient convection heat transfer per unit length of grid is achieved with the use of expanded metal, since this structure inherently presents a multitude of small air foils which create turbulent air flow in an area of close proximity to the grid planes. Ideally, each plane of the expanded foil contains at least two grid sections having their grains running in opposite directions. A deflector or baffle plate at the exit end of the heater device causes the airstreams issuing from the areas of oppositely running grain sections to be intermingled for substantially complete uniformity in temperature throughout the cross section of the discharge area.

BRIEF DESCRIPTION OF THE DRAWINGS

FIG. 4 is an enlarged, schematic view of the resistance grid, taken along line 4—4 of FIG. 3; and FIG. 5 is an enlarged, schematic view of the resistance grid, taken along line 5—5 of FIG. 3, showing a reversed grain direction in the lower grid stratum as compared to the grid of FIG. 4.

DESCRIPTION OF THE PREFERRED EMBODIMENT

Figure 1:
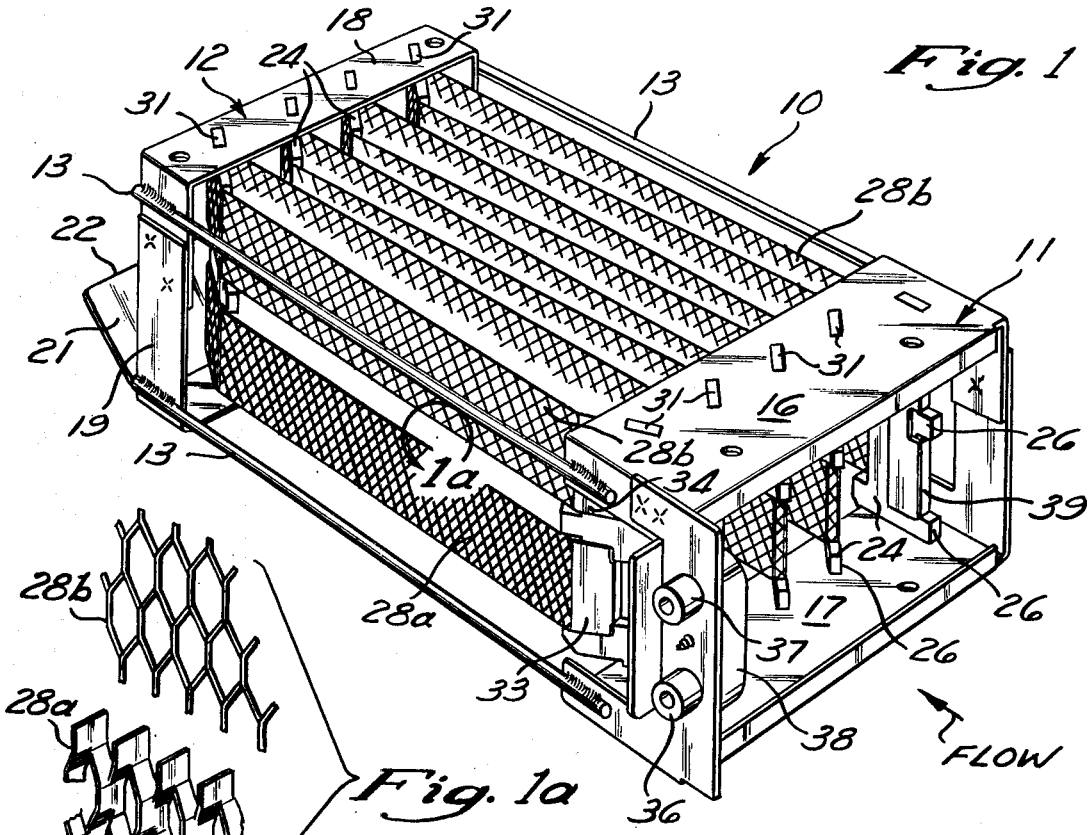
FIG. 1 is a perspective view of an electrical heater assembly constructed in accordance with the present invention.

Referring now to the drawings, an electrical resistance heater assembly is indicated generally at 10 in FIG. 1. The assembly 10 includes a rigid, open, rectangular frame having end brackets 11 and 12 at a flow entrance face and an exit face, respectively. The brackets 11 and 12 are joined by a set of four longitudinally extending rods 13 welded or otherwise suitably secured to the end brackets. As illustrated, the end brackets 11 and 12 may be fabricated by welding or otherwise securing respective pairs of U-shaped elements 16 and 17 at the entrance and 18 and 19 at the exit. The brackets 11 and 12 and associated rods 13 are formed of steel or other structural material suitable for moderately high temperature service. The brackets 11 and 12 each surround respective rectangular areas that represent the cross sectional area of a flow passage through the assembly 10.

Integral with the U-shaped element 19 of the exit bracket 12 is a flow deflector 21 which extends substantially across the width of the exit area. The deflector 21 is inclined with respect to the longitudinal direction of the assembly 10 at an angle of approximately 45 degrees, so that its projection into the flow stream is approximately or slightly less than halfway across the vertical dimension of the exit area as viewed in FIG. 1. That is, an upper edge 22 of the deflector is approximately midway between the planes of the bights of the U-shaped brackets 18 and 19.

A plurality of electrically insulating support blocks 24 are strategically mounted in the inlet and outlet brackets 11 and 12. The insulator blocks 24 may be conventionally formed of a refractory material, such as a refractory metal oxide composition. The insulator blocks 24 are provided in the form of identical elongated solid bars extending between the associated U-shaped elements 16, 17 and 18, 19. Integral transverse projections 26 are provided on the blocks to suitably restrain strips 28*a* and 28*b* of electrical resistance grid material from relative movement along the lengths of the blocks and contact therebetween. Longitudinally extending tabs 31 having rectangular or other acircular cross section at each end of the blocks 24 are received in complementary holes in respective areas of the brackets 11 and 12. The blocks 24, with the exception of the outward blocks at the entrance bracket 16, are held at an angle of inclination of approximately 30 to 45 degrees from the longitudinal direction of the assembly 10.

Figure 1A:
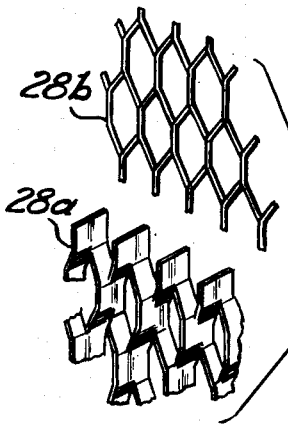
FIG. 1*a* is an enlarged, fragmentary view of the encircled area in FIG. 1, showing the oppositely extending grains of a set of coplanar grid sections cooperating to form a longitudinal perforate wall or reach of grid material.
Figure 2:
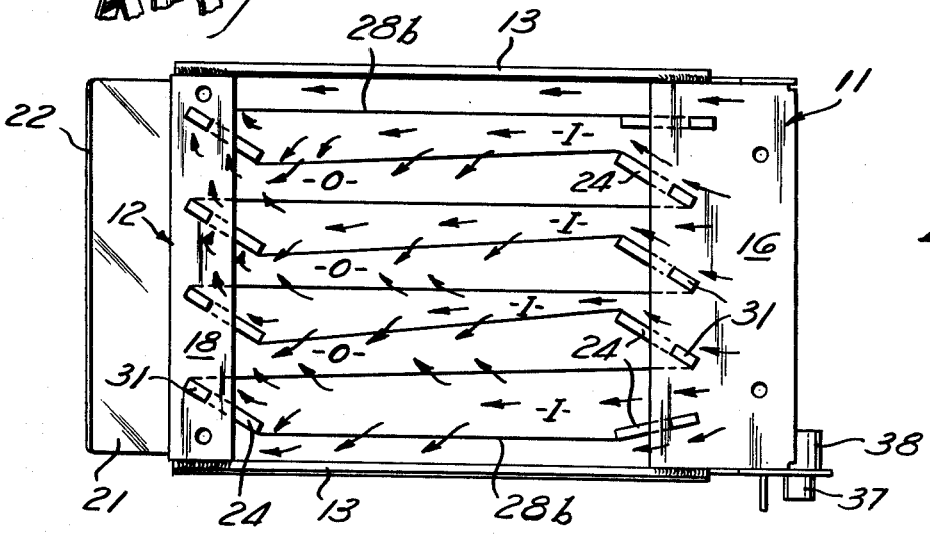
FIG. 2 is an elevational view of the electrical heater assembly as viewed from the upper side of FIG. 1.
Figure 3:
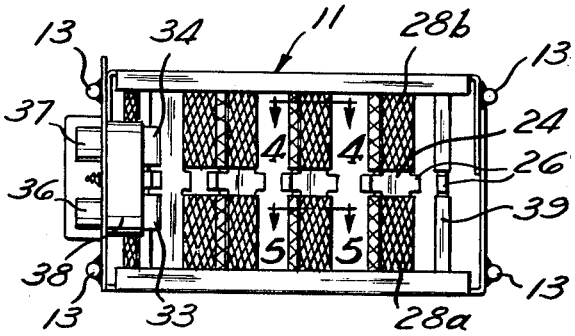
FIG. 3 is an end elevational view of the heater assembly.

The resistance grid 28 is strung over the insulator blocks 24 in a sinuous path, illustrated most clearly in FIG. 2. The resistance grid 28 preferably comprises an expanded resistance alloy metal foil such as that disclosed in the aforementioned U.S. Pat. No. 3,651,304 to Fedor, the entire disclosure of which is incorporated herein by reference. Preferably, though not necessarily, the grid is provided as two separate strips 28*a* and 28*b*, at lower and upper strata, respectively, as viewed in FIG. 1. Each strip 28*a* and 28*b* has an electrically conducting band 33, 34 connected to an associated female electrical receptacle disposed within circular projections 36 and 37 of an electrically insulating terminal block 38. The block 38 is formed of ceramic or other material suitable for moderate temperature service, and is secured by a screw or other means to one leg of the bracket element 17. The opposite ends of these grid strips 28*a* and 28*b* are electrically joined to one another by a jumper strip 39 (FIG. 1), spot welded or otherwise joined thereto. The strips 28*a*, 28*b* are thereby adapted to be energized by an external electrical energy source, such as utility lines connected to the receptacles within the projections 36, 37. As illustrated most clearly in FIGS. 1*a*, 4, and 5, the strips 28*a* and 28*b* are arranged with their grain running in opposite directions at the plane of each longitudinal reach or wall formed by the strips between the insulators 24.

The disclosed structure of the resistance heater assembly 10 is particularly suited for use in a domestic clothes dryer, wherein the unit is mounted in a suitable duct by screws or other fastening means engaging the end brackets 11 and 12. The duct in which the assembly 10 is conventionally mounted constrains air for movement parallel to the longitudinal rods 13, and generally within the cross sectional area defined by the end brackets 11 and 12. Air is forcibly driven by a suitable blower through the flow passage bounded by the end brackets 11 and 12, ultimately to circulation in a chamber where clothes are ordinarily tumbled.

As illustrated most clearly in FIG. 2, the insulator blocks 24 support the resistance grid 28 in planar reaches generally parallel to the longitudinal direction of the assembly 10, which corresponds to the net direction of air flow therethrough. Since the insulator blocks 24 are impenetrable, air flow is directed or restricted by the blocks associated with the inlet bracket 11 into spaced inlet channels or corridors identified by the symbol I. Intervening the inlet channels I are corresponding outlet channels O.

Air flowing forwardly along the inlet channels I is transferred to the outlet channels O by passage through the perforations of the resistance grid 28 under a number of influences. These influences include the air scoop effect of the grain of the expanded metal grid 28. The orientation of the sections of the grid which produces this action is indicated at 42 and 43 in FIGS. 4 and 5. A second manner in which air is transferred from the inlet channels I to the outlet channels O is by the deflection and turbulence caused by impingement of air in the inlet channels against the downstream insulator blocks 24 associated with the outlet bracket 12. Once in the outlet channels O, air movement may entrain additional flow through the grid from the inlet channels I.

It may be appreciated that, owing to the substantially greater length of the grid reaches between the insulator blocks 24 to the spacing of the planes of these reaches, the flow disruptive surface of the grid, and the flow blockage or restriction afforded by the downstream terminal blocks at the exit 12, a great deal of turbulence is produced at and adjacent the exit end of the assembly 10. This intensive turbulence is conducive to efficient convection heat transfer between the air and resistance grid. The increased turbulence at the exit end tends to offset the negative heat transfer effect associated with a decrease in differential temperature between the air, progressively heated to elevated temperatures on its passage through the assembly, and the heater grid area adjacent the exit. The turbulence also assures that the grid portions designated 46 shielded by the insulators 24 at the exit are adequately cooled by air flow to prevent localized hot spots in the resistance grid and premature failure of such areas.

Temperature uniformity of the airstream bounded by the rectangular area of the exit bracket 12 is the result of at least three factors. A principal factor is the substantially uniform spacing of the points of path reversal and spacing of the grid planes established by the insulator blocks 24 uniformly across the total rectangular flow path. Another factor in the resulting uniform temperature distribution is the alternating direction of grain of the expanded metal grid, both horizontally across the level or stratum of a given strip 28*a* or 28*b* and between these strata. A third contributing factor is the deflector plate 21, which directs and intermixes the stream of air generally associated with the lower strip 28*a* into the stream exiting from the stratum of the upper strip 28*b*. Moreover, the disclosed structure in which the resistance grid is arranged in planes generally parallel to the net flow direction, thereby requiring air to pass through only one course of the grid, results in a device which has comparatively low flow restriction, so that very little pressure drop is experienced by an airstream passing through the assembly.

While there have been described what are at present considered to be the preferred embodiments and aspects of this invention, it will be obvious to those skilled in the art that various changes and modifications may be made therein without departing from the invention, and it is intended, therefore, in the appended claims to cover all such changes and modifications as fall within the true spirit and scope of the invention.

What is claimed is:

1. An electrical heater assembly comprising a supporting frame defining a two dimensional fluid inlet at one face and a two-dimensional outlet at an opposite face, a plurality of generally parallel planes extending lengthwise between the inlet and outlet faces generally perpendicular to the inlet and outlet faces, said planes being spaced from one another along one dimension of said inlet and outlet and extending widthwise fully across the other dimension of the inlet and outlet, at least one thin, substantially flat length of perforated resistance grid material arranged to lie in each of said planes, the resistance grid material of each plane extending lengthwise along substantially the full length of the plane and across substantially the full width of the plane, means on said frame for supporting said lengths of resistance grid material in their respective planes, the lengths of resistance grid material lying in adjacent planes forming flow paths therebetween, the spacing between said lengths of resistance grid material being substantially less than the lengthwise extent of said lengths of resistance grid material between the inlet and outlet, the area between the resistance grid material of adjacent planes intermediate the inlet and outlet being substantially unrestricted, and means restricting the downstream end of alternate ones of said flow paths whereby fluid flowing through said alternate ones of said flow paths and approaching said restricting means is substantially entirely deflected laterally through the perforations of portions of the adjacent grid lengths defining said alternate ones of said flow paths, the downstream ends of the intervening flow paths between said alternate ones of said flow path being constructed and arranged to permit passage of fluid from said alternate ones of said flow paths through said outlet and to produce substantial additional turbulence in said flow paths adjacent the outlet such that heat transfer between said fluid and the portions of said grid adjacent said outlet is enhanced to offset the negative heat transfer effect associated with a decrease in differential temperature between the fluid and said grid portions adjacent the outlet.

2. An electrical resistance heater assembly for heating an airstream passing therethrough by convection, including a frame defining a flow passage having a two-dimensional cross section, said flow passage having an inlet at one end and an outlet at the other end, a plurality of lengths of substantially flat, perforated resistance metal grids arranged to lie in planes generally parallel to the net air flow direction through the flow passage of the assembly, said planes being laterally spaced from each other across one cross section dimension, extending widthwise fully across the other cross section dimension, and lengthwise fully along the length of said flow passage, the resistance metal grid lying in each plane extending across a major portion of the width and along the length of such plane, means blocking flow of air through alternate spaces between said planes at said inlet of said flow passage and means blocking flow of air only from the intervening spaces between said alternate spaces at said outlet of said flow passage whereby air is forced to pass laterally through the perforations of at least one course of resistance grid in passage through said assembly.

3. A heater assembly as set forth in claim 2, wherein at least some of said plurality of lengths of resistance metal grids are comprised of at least one continuous strip of resistance grid material strung in a sinuous path back and forth between said blocking means at said inlet and the blocking means at said outlet.

4. An electrical resistance heater assembly for heating an airstream passing therethrough by convection, including a frame defining a flow passage having a rectangular cross section, a plurality of lengths of resistance metal expanded foil, said flow passage having an inlet at one end and an outlet at the other end, said lengths being arranged to individually lie in planes extending longitudinally between said inlet and said outlet, said planes being generally parallel and laterally spaced within the rectangular cross section, said planes extending widthwise fully across the cross section, the expanded foil of each plane extending substantially across the full width of such plane, and means associated with the lengths of foil at the inlet and outlet of the flow passage to deflect substantially all portions of the airstream through associated lengths of the expanded foil.

5. A heater assembly as set forth in claim 4, wherein at least some of said lengths of said expanded foil are strung in a sinuous path back and forth across support means at each end of said assembly.

6. A heater assembly as set forth in claim 5, wherein said support means provides said deflecting means, said support means at each point of reversal of said foil having sufficient area to block alternate spaces between said planes at said inlet and sufficient area to block the intervening spaces between said alternate spaces at said outlet.

7. A heater assembly as set forth in claim 6, wherein said lengths of expanded foil are provided as a pair of continuous strips coextensive in length, each strung side-by-side in laterally spaced relation.

8. A heater assembly as set forth in claim 7, wherein said strips are arranged with their grains extending in opposite directions relative to each other in common planes and are supported in the frame in a manner permitting air from each heating strip of a plane to freely intermingle and mix with air from the other due to the turbulence created by the opposite grain orientation of the strips.

9. A heater assembly as set forth in claim 6, including a flow deflector immediately downstream of said outlet, said deflector being arranged across a limited portion of the area of the airstream at an obtuse angle to divert air impinging on said deflector into the remaining portion of the airstream.

10. A heater assembly as set forth in claim 9, wherein the projected area of the deflector is approximately equal to one-half the area of said outlet.

11. A heater assembly as set forth in claim 10, wherein said deflector is arranged in a plane perpendicular to the planes of said expanded foil.

12. A forced convection electrical resistance heater assembly comprising a support frame defining an inlet and an outlet having substantially equal cross sectional areas, a plurality of insulator blocks mounted at the inlet and outlet, a pair of strips of resistance metal expanded foil strung in a sinuous path over said insulator blocks, said insulator blocks being arranged to support each of said strips as serially connected reaches in a plurality of longitudinal, generally parallel planes, said strips each having a width equal to at least a major portion of one-half of one dimension of said cross sectional area, said strips each having one end connected to a separate terminal and having an opposite end connected to that of the other, each of said strips in a given longitudinal plane having its grain running in a direction opposite to that of the other, said frame being constructed and the strips of each plane being supported thereby in a manner permitting the air flowing through each strip to freely mix and intermingle with the air flowing through the other strip due to the turbulence created by the opposite strip grain orientation, and deflector means at said outlet, said deflector being inclined with respect to the net flow direction through the assembly and extending from one edge of the cross sectional area inwardly to form a projection substantially midway across said cross sectional area to intermix the portion of air passing through the zone of one of said strips with that of the other to improve the temperature uniformity of air leaving said assembly.

13. A forced convection electrical resistance heater assembly comprising a support frame defining an inlet and an outlet having substantially equal cross-sectional areas, a plurality of insulator blocks mounted at the inlet and outlet, and a pair of strips of resistance metal expanded foil strung in a sinuous path over said insulator blocks, said insulator blocks being arranged to support each of said strips as serially connected reaches in a plurality of longitudinal, generally parallel planes, said strips each having a width equal to at least a major portion of one-half of one dimension of said cross-sectional area, said strips each having one end connected to a separate terminal and having an opposite end connected to that of the other, each of said strips in a given longitudinal plane having its grain running in a direction opposite to that of the other, said frame being constructed and the strips of each plane being supported thereby in a manner permitting the air flowing through each strip to freely mix and intermingle with the air flowing through the other strip due to the turbulence created by the opposite strip grain orientation.

* * * * *